US009139920B1

(12) United States Patent
Kauffman et al.

(10) Patent No.: US 9,139,920 B1
(45) Date of Patent: Sep. 22, 2015

(54) EFFICIENT ELECTROCATALYTIC CONVERSION OF $CO_2$ TO CO USING LIGAND-PROTECTED $AU_{25}$ CLUSTERS

(71) Applicants: Douglas Kauffman, Pittsburgh, PA (US); Christopher Matranga, Pittsburgh, PA (US); Huifeng Qian, Pearland, TX (US); Rongchao Jin, Pittsburgh, PA (US); Dominic R. Alfonso, Pittsburgh, PA (US)

(72) Inventors: Douglas Kauffman, Pittsburgh, PA (US); Christopher Matranga, Pittsburgh, PA (US); Huifeng Qian, Pearland, TX (US); Rongchao Jin, Pittsburgh, PA (US); Dominic R. Alfonso, Pittsburgh, PA (US)

(73) Assignee: U.S. Department of Energy, Washington, DC (US)

( * ) Notice: Subject to any disclaimer, the term of this patent is extended or adjusted under 35 U.S.C. 154(b) by 124 days.

(21) Appl. No.: 14/045,886

(22) Filed: Oct. 4, 2013

Related U.S. Application Data

(60) Provisional application No. 61/795,166, filed on Oct. 11, 2012.

(51) Int. Cl.
*C25B 9/16* (2006.01)
*C25B 11/04* (2006.01)

(52) U.S. Cl.
CPC ..... *C25B 9/16* (2013.01)

(58) Field of Classification Search
CPC ..... C25B 11/04–11/0494; C25B 9/00
USPC ..... 204/280, 290.41, 290.08
See application file for complete search history.

(56) References Cited

PUBLICATIONS

Wei Chen and Shaowei Chen, "Oxygen Electroreduction Catalyzed by Gold Nanoclusters: Strong Core Size Effects" Angew. Chem. Int. Ed. 2009, 48, 4386-4389.*

H. C. Hurrell et al "Electrocatalytic Activity of Electropolymerized Films of Bis(vinylterpyridine)cobalt(2+) for the Reduction of Carbon Dioxide and Oxygen" Inorganic Chemistry, vol. 28, No. 6, 1989.*

(Continued)

*Primary Examiner* — James Lin
*Assistant Examiner* — Leo Ahnn
(74) *Attorney, Agent, or Firm* — James B. Potts; Brian J. Lally; John T. Lucas

(57) ABSTRACT

An apparatus and method for $CO_2$ reduction using an $Au_{25}$ electrode. The $Au_{25}$ electrode is comprised of ligand-protected $Au_{25}$ having a structure comprising an icosahedral core of 13 atoms surrounded by a shell of six semi-ring structures bonded to the core of 13 atoms, where each semi-ring structure is typically —SR—Au—SR—Au—SR or —SeR—Au—SeR—Au—SeR. The 12 semi-ring gold atoms within the six semi-ring structures are stellated on 12 of the 20 faces of the icosahedron of the $Au_{13}$ core, and organic ligand —SR or —SeR groups are bonded to the $Au_{13}$ core with sulfur or selenium atoms. The $Au_{25}$ electrode and a counter-electrode are in contact with an electrolyte comprising $CO_2$ and H+, and a potential of at least −0.1 volts is applied from the $Au_{25}$ electrode to the counter-electrode.

7 Claims, 5 Drawing Sheets

(56) References Cited

PUBLICATIONS

C. Delacourt et al., "Design of an Electrochemical Cell Making Syngas (CO + H2) from CO2 and H2O Reduction at Room Temperature" Journal of the Electrochemical Society, 155 (1) B42-B49 2008.*

J. Carroll et al. "The Solubility of Carbon Dioxide in Water at Low Pressure" J.Phys. Chem. Ref. Data, vol. 20, No. 6, 1991.*

Zhu et al., "Correlating the Crystal Structure of a Thiol-Protected Au25 Cluster and Optical Properties" J. Am. Chem. Soc. vol. 130, No. 18, 2008.*

Kauffman et al., "Experimental and Computational Investigation of Au25 Clusters, and CO2: A Unique Interaction and Enhanced Eiectrocatalytic Activity," J. Am. Chem. Soc. 134 (2012).

Kauffman et al., "Supporting Information for Experimental and Computational Investigation of Au25 Clusters and CO2: A Unique Interaction and Enhanced Electrocatalytic Activity," J. Am. Chem. Soc. 134 (2012).

Zhu et al., "Correlating the Crystal Structure of a Thiol-Protected Au25 Cluster and Optical Properties," J. Am. Chem. Soc. 130 (2008).

Zhu et al., "Atomically Precise Au25(SR)18 Nanoparticles as Catalysts for the Selective Hydrogenation of a,b-Unsaturated Ketones, and Aldehydes," Angew. Chem. 122(2010).

Zhu et al., "Kinetically Controlled, High-Yield Synthesis of Au25 Clusters," J. Am. Chem. Soc. 130 (2008).

* cited by examiner

EFFICIENT ELECTROCATALYTIC CONVERSION OF $CO_2$ TO CO USING LIGAND-PROTECTED $AU_{25}$ CLUSTERS

RELATION TO OTHER APPLICATIONS

This patent application claims priority from provisional patent application 61/795,166 filed Oct. 11, 2012, which is hereby incorporated by reference.

GOVERNMENT INTERESTS

The United States Government has rights in this invention pursuant to the employer-employee relationship of the Government to the inventors as U.S. Department of Energy employees and site-support contractors at the National Energy Technology Laboratory, and pursuant to AFOSR Award No. FA9550-11-1-9999 (FA9550-11-1-0147).

FIELD OF THE INVENTION

One or more embodiments of the present invention relate to an apparatus and method of $CO_2 \rightarrow CO$ reduction using an $Au_{25}$ electrode comprised of ligand-protected $Au_{25}$, where the ligand-protected $Au_{25}$ comprises an icosahedral core of 13 atoms surrounded by a shell of six —SR—Au—SR—Au—SR semi-ring structures, where SR represents organic ligands

BACKGROUND

The chemistry of gold (Au) surfaces and Au nanoparticles has been the focus of intense study, but recent synthetic advances have introduced a new class of "small" ligand-protected Au clusters with unique chemical and electronic properties. Ousters smaller than ~2 nanometers (nm) in diameter differ from larger nanoparticles because their energy levels become quantized and they develop molecule-like electronic structures. Crystallographic efforts have confirmed that such small Au clusters form into atomically precise structures, and that some species, such as ligand-protected $Au_{25}$ clusters, possess an inherent anionic (negative) charge. Ligand-protected $Au_{25}$ clusters are a unique platform to study catalytic reactions because they bridge the size gap between molecules and larger nanoparticles, they possess an anionic charge, and their surface structure is precisely known. Despite these features, the catalytic activity of $Au_{25}$ and similar atomically precise clusters have only been investigated experimentally for a handful of reactions, such as the oxidation of styrene and cyclohexane, the hydrogenation of aldehydes and ketones, and the electrochemical reduction of $O_2$. One particularly appealing catalytic challenge to consider for the negatively charged $Au_{25}$ cluster is the reduction of carbon dioxide. Not only is $CO_2$ an important greenhouse gas, but it also represents an abundant starting material for the generation of fine chemicals and fuels.

These and other objects, aspects, and advantages of the present disclosure will become better understood with reference to the accompanying description and claims.

SUMMARY

The present disclosure is directed to an apparatus and method for $CO_2$ reduction using an $Au_{25}$ electrode. The $Au_{25}$ electrode is comprised of ligand-protected $Au_{25}$ having a structure comprising an icosahedral core of 13 atoms surrounded by a shell of six semi-ring structures bonded to the core of 13 atoms. Each semi-ring structure is typically —SR—Au—SR—Au—SR, where SR represents an organic ligand having a sulfur (S) head group, or —SeR—Au—SeR—Au—SeR, where SeR represents an organic ligand having a selenium (Se) head group. The 12 semi-ring gold atoms within the six semi-ring structures are stellated on 12 of the 20 faces of the icosahedron of an $Au_{13}$ core, and organic ligand SR groups are bonded to the $Au_{13}$ core with sulfur or selenium atoms.

The apparatus and method utilizes an electrochemical cell where the $Au_{25}$ electrode and a counter-electrode are in contact with an electrolyte comprising $CO_2$ and H+, and a potential of at least −0.1 volts is applied from the $Au_{25}$ electrode to the counter-electrode. In an embodiment, the potential is from about −0.8 to about −1.2 volts. The negatively charged $Au_{25}$ working electrode interacts with H+ ions and $CO_2$ in the electrolyte and generates CO from the reduction of the $CO_2$. In an embodiment, the electrolyte is aqueous. In another embodiment, the $Au_{25}$ working electrode is immersed in the electrolyte in a working electrode compartment and the counter-electrode is immersed in the electrolyte in a counter-electrode compartment, and the working electrode compartment and the counter-electrode compartment are separated by a proton-exchange membrane to mitigate the passage of $CO_2$ reduction products from the working electrode compartment to the counter-electrode compartment, while still allowing current flow via proton conduction from the counter-electrode compartment to the working electrode compartment. In another embodiment, the working electrode compartment is sealed with a gas-tight lid to allow collection of the generated CO and other reaction products.

Spontaneous coupling between the negatively charged $Au_{25}$ cluster and $CO_2$ allows highly effective $Au_{25}$ use as a catalyst for the electrochemical reduction of $CO_2$ at generally reduced potentials and high Faradaic efficiency. The apparatus and method produces peak $CO_2 \rightarrow CO$ conversion at a potential generally around −1.0 V with approximately 100% Faradaic efficiency and a rate 7-700 times higher than those for current state-of-the-art processes.

The novel process and principles of operation are further discussed in the following description.

DETAILED DESCRIPTION

The following description is provided to enable any person skilled in the art to use the invention and sets forth the best mode contemplated by the inventor for carrying out the invention. Various modifications, however, will remain readily apparent to those skilled in the art, since the principles of the present invention are defined herein specifically to provide a method for the reduction of $CO_2$ using an $Au_{25}$ electrode comprised of ligand-protected $Au_{25}$.

Generally, the present disclosure is directed to a spontaneous and reversible electronic interaction between $CO_2$ and ligand-protected $Au_{25}$ clusters. Spontaneous coupling between the negatively charged $Au_{25}$ duster and $CO_2$ allows highly effective $Au_{25}$ use as a catalyst for the electrochemical reduction of $CO_2$ at generally reduced potentials and high Faradaic efficiency. The disclosure provides a process and apparatus where an $Au_{25}$ working electrode and a counter-electrode are immersed in an electrolyte comprised of $CO_2$ and H+ ions, and an electrochemical voltage of at least −0.1 volts is applied from the $Au_{25}$ working electrode to the counter-electrode. The negatively charged $Au_{25}$ working electrode interacts with H+ ions and $CO_2$ in the electrolyte and generates CO from the reduction of the $CO_2$. In an embodiment, the electrolyte is aqueous. In another embodiment, the $Au_{25}$ working electrode is immersed in the electrolyte in a working electrode compartment and the counter-electrode is immersed in the electrolyte in a counter-electrode compartment, and the working electrode compartment and the counter-electrode compartment are separated by a proton-exchange membrane to mitigate the passage of $CO_2$ reduction products from the working electrode compartment to the counter-electrode compartment, while still allowing current flow via proton conduction from the counter-electrode compartment to the working electrode compartment. In another embodiment, the working electrode compartment is sealed with a gas-tight lid to allow collection of the generated CO and other reaction products.

Figure 1:
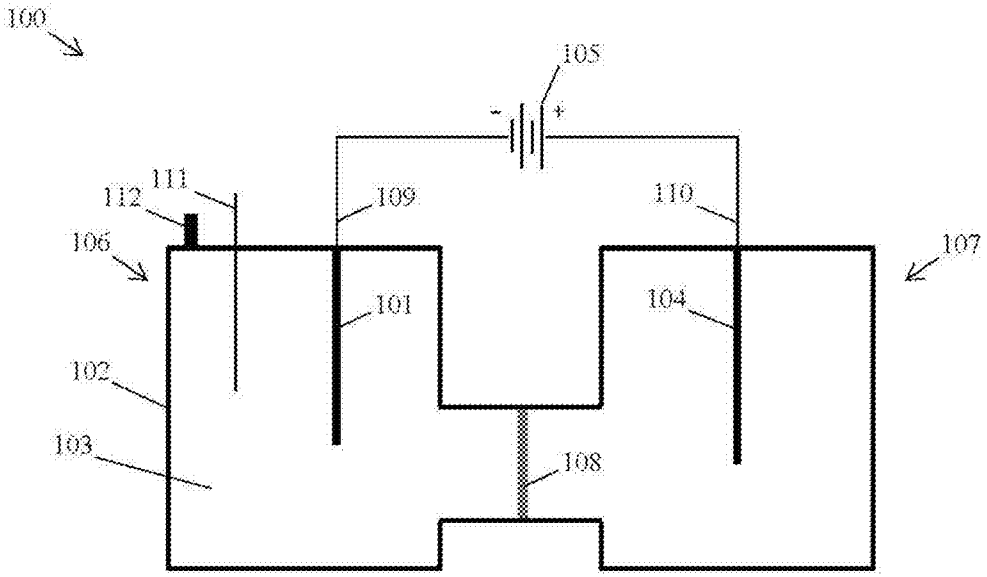
FIG. 1 illustrates an electrochemical cell utilizing the $Au_{25}$ electrode.

An exemplary arrangement is illustrated at FIG. 1. FIG. 1 illustrates an electrochemical cell generally at 100. An electrolyte container 102 holds an electrolyte 103, where electrolyte 103 is comprised of $CO_2$ and H+ ions. An $Au_{25}$ electrode 101 and a counter-electrode 104 is immersed within electrolyte 103. $Au_{25}$ electrode 103 is in electrical communication with $Au_{25}$ electrode lead 109 and counter electrode 104 is in electrical contact with counter electrode lead 110. A voltage source 105 has a negative terminal (−) and a positive terminal (+) electrically connected to $Au_{25}$ electrode lead 109 and counter electrode lead 110 respectively. In the embodiment of FIG. 1, electrolyte container 102 comprises a working electrode compartment generally indicated at 106 and a counter-electrode compartment generally indicated at 107, with proton-exchange membrane 108 separating working electrode compartment 106 and counter-electrode compartment 107. As illustrated, $Au_{25}$ electrode 101 is immersed in electrolyte 103 in working electrode compartment 106 while counter-electrode 104 is immersed in electrolyte 103 in counter-electrode compartment 107. Electrochemical cell 100 may be further comprised of reference electrode 111, as illustrated.

In operation, voltage source 105 provides a potential of at least −0.1 volts (V) from the negative terminal (−) and the positive terminal (+) and establishes a potential of at least −0.1 V from $Au_{25}$ electrode 101 to counter-electrode 104, via $Au_{25}$ electrode lead 109 and counter electrode lead 110. Contact between $Au_{25}$ electrode 101 and electrolyte 103 when voltage source 105 provides the potential of at least −0.1 V as described generates CO and $H_2$ at Au25 electrode 101. In an embodiment, voltage source 105 establishes a potential of from about −0.5 V to about −1.5 V from $Au_{25}$ electrode 101 to counter-electrode 104. In a further embodiment, voltage source 105 establishes a potential of from about −0.8 V to about −1.2 V from $Au_{25}$ electrode 101 to counter-electrode 104. The generated CO and $H_2$ may be withdrawn from electrochemical cell 101 using, for example working electrode compartment outlet 112.

As described, $Au_{25}$ electrode 101 is comprised of ligand-protected $Au_{25}$. Here "ligand-protected $Au_{25}$" means a material having a structure comprising an icosahedral core of 13 atoms surrounded by a shell of six semi-ring structures bonded to the core of 13 atoms. In an embodiment, the each semi-ring structure is —SR—Au—SR—Au—SR, where SR represents an organic ligand having a sulfur (S) head group, or —SeR—Au—SeR—Au—SeR, where SeR represents an organic ligand having a selenium (Se) head group. The crystal structure of the ligand-protected $Au_{25}$ comprises one central gold atom having a coordination number of 12 and bonded to 12 additional gold atoms, where each of the 12 additional gold atoms forms a vertex of an icosahedron around the central gold atom, such that the one central gold atom and the 12 additional gold atoms form an $Au_{13}$ core. Additionally, 12 semi-ring gold atoms are stellated on 12 of the 20 faces of the icosahedron of the $Au_{13}$ core within the six semi-ring structures, where the organic ligand SR or SeR groups are bonded to the $Au_{13}$ core with sulfur or selenium atoms. Each —SR—Au—SR—Au—SR semi-ring structure comprises an Au—Au pair bridged by a first —SR or —SeR ligand, with a second —SR or —SeR ligand bridging one Au atom in the Au—Au pair to the $Au_{13}$ core, and a third —SR or —SeR ligand bridging the other Au atom in the Au—Au pair to the $Au_{13}$ core, such that the $Au_{25}$ cluster is capped by eighteen —SR or —SeR ligands. See e.g. Heaven et al., "Crystal Structure of the Gold Nanopartide $[N(C_8H_{17})_4][Au_{25}(SCH_2CH_2Ph)_{18}]$," *J. Am. Chem. Soc.* 130 (2008), and see Zhu et al., "Correlating the Crystal Structure of a Thiol-Protected $Au_{25}$ Cluster and Optical Properties," *J. Am. Chem. Soc.* 130 (2008), and see Kauffman et al., "Experimental and Computational Investigation of $Au_{25}$ Clusters and $CO_2$: A Unique Interaction and Enhanced Electrocatalytic Activity," *J. Am. Chem. Soc.* 134 (2012).

The organic ligand SR or —SeR groups may comprise carbon atoms with any number of C—C bonds, S—C bonds, Se—C bonds, C—N bonds, C—O bonds, C—H bonds, or carbon bonded with any other element. Carbon chains may be any length and may be linear, branched, or cyclic. The ligands may have organic or water soluble moieties along the length at the end. Exemplary organic ligands include but are not limited to phenylethyl mercaptan, mercaptohexane, captropril, glutathione, mercaptobutanol, thiomalate, mercaptobenzoic acid, selenomethionine, mercaptopropionic acid, mercaptobutyric acid, mercapto-1,2-propanediol, cysteine, mercaptomethane, mercaptoethane, mercaptopropane, mercaptobutane, mercaptoethanol, mercaptomethanol, mercaptopropanol, mercaptoethylamine, mercaptoacetic acid, 1H-1,2,4-triazole-3-thiol, 5-mercapto-1-methyltetrazole, 2-mercapto-1-methylimidazole, 2-mercaptothiazoline, ethyl-2-mercaptoacetate, 2-thiouracil, 2-mercapto-5-methyl-1,3,4-thiadiazole, D-(−)-penicillamine, mercaptobenzimidazole, mercaptobenzoxazole, N-acetylL-cysteine, 2-mercapto-6-nitrobenzothiazole, 2-amino-6-mercaptopurine-9-D-riboside hydrate, diisoamylthiomalate, 3-mercaptopropanol, 4-mercaptobutanol, 2-(dimethylamino) ethanethiol, 2-mercapto-5-methyl-1,3,4-thiadiazole, and 4,5-diamino-2,6-dimercaptopyrimidine, among others.

The $Au_{25}$ electrode 101 may be generally comprised of a plurality of nanoparticles, where individual nanoparticles in the plurality are comprised of ligand-protected $Au_{25}$ as described. The $Au_{25}$ electrode may be additionally comprised of an electrically conductive support and an electrode binder, such as a conductive carbon black support and NAFION, or may be comprised of a conductive binder material such as a conductive carbon cement. The electrically conductive support and electrode binder, or the conductive binder material, may be present in $Au_{25}$ electrode 101 in an amount of from 0.01% to 90% by weight of the total $Au_{25}$ electrode 103 weight. $Au_{25}$ electrode 101 may have any physical configuration provided that the physical configuration allows contact between the ligand-protected $Au_{25}$ comprising $Au_{25}$ electrode 101 and the $CO_2$ and H+ comprising electrolyte 103. For example, $Au_{25}$ electrode 101 may be a coated electrode, a gas diffusion electrode, or any other electrode which allows $Au_{25}$ electrode 101 and electrolyte 103 contact as described.

Counter-electrode 104 may be any conductive material. In an embodiment, counter-electrode 104 is comprised of a noble metal, such as platinum.

As described, electrolyte 103 is comprised of $CO_2$ and H+ ions. In an embodiment, electrolyte 103 contains at least 0.01 moles $CO_2$ per liter of electrolyte. In a further embodiment, electrolyte 103 is present in the apparatus and method at a specific temperature and specific pressure, and electrolyte 103 contains an amount of $CO_2$ equal to at least 10%, at least 30%, or at least 50%, of the $CO_2$ present when electrolyte 103 is saturated with $CO_2$ at the specific temperature and specific pressure. Electrolyte 103 may be a liquid electrolyte or a solid electrolyte, such as a gel electrolyte, a polymer electrolyte, a ceramic electrolyte, or others. Electrolyte 103 may be an aqueous or non-aqueous electrolyte. In an embodiment, electrolyte 103 is an aqueous solution comprising $H_2O$ and $HCO_3$, $H_2CO_3$, or mixtures thereof. Within this disclosure, when electrolyte 103 is comprised of $CO_2$ and H+ ions, this means the electrolyte may comprise $CO_2$ and H+ as individual entities, or may comprise one or more substances which interact with $Au_{25}$ electrode 101 to generate $CO_2$ and H+ when $Au_{25}$ electrode 101 operates within electrochemical cell 100 under the conditions described. For example, within this disclosure, the aqueous solution comprising $H_2O$ and $HCO_3$, $H_2CO_3$, or mixtures thereof falls within an electrolyte comprising $CO_2$ and H+.

In embodiments where electrochemical cell 100 comprises working electrode compartment 106 and counter-electrode compartment 107, proton-exchange membrane 108 may be any material sufficient to mitigate the passage of $CO_2$ reduction products from working electrode compartment 106 to counter-electrode compartment 107, while still allowing current flow via proton conduction from counter-electrode compartment 107 to working electrode compartment 106. Exemplary proton-exchange membrane 108 materials include but are not limited to NAFION, fritted glass, salt bridges, and others known in the art.

Description of an Embodiment

Ligand-protected $Au_{25}$ was prepared using known techniques. See e.g. Zhu et al., "Kinetically Controlled, High-Yield Synthesis of Au25 Ousters," *J. Am. Chem. Soc.* 130 (2008), among others. Electrochemical $CO_2$ reduction was conducted in a two compartment cell. The Ligand-protected $Au_{25}$ was mixed with a conductive carbon black support (Vulcan XC-72; Cabot corp.) and an electrode binder (NAFION), and deposited onto a glassy carbon working electrode. This electrode was immersed in a $CO_2$ saturated electrolyte (0.1M $KHCO_3$). A reference electrode (Ag/AgCl) was also placed in the working electrode compartment. The reference electrode was calibrated into the reversible hydrogen electrode (RHE) scale ($E_{RHE}=E_{ref}+0.059*pH$). A gas-tight lid sealed the working electrode compartment to allow collection of the reaction products. A platinum (Pt) counter electrode was immersed in the second compartment in the same electrolyte in the counter electrode compartment. A proton-exchange membrane separated the two compartments. The membrane prevented $CO_2$ reduction products from escaping the working electrode compartment, but it still allowed current flow via proton conduction. Electrochemical potentials greater than −0.103 V vs. RHE were applied to the $Au_{25}$ catalyst through the working electrode. Maximum performance was observed at −1.0 V vs. RHE.

Figure 2:
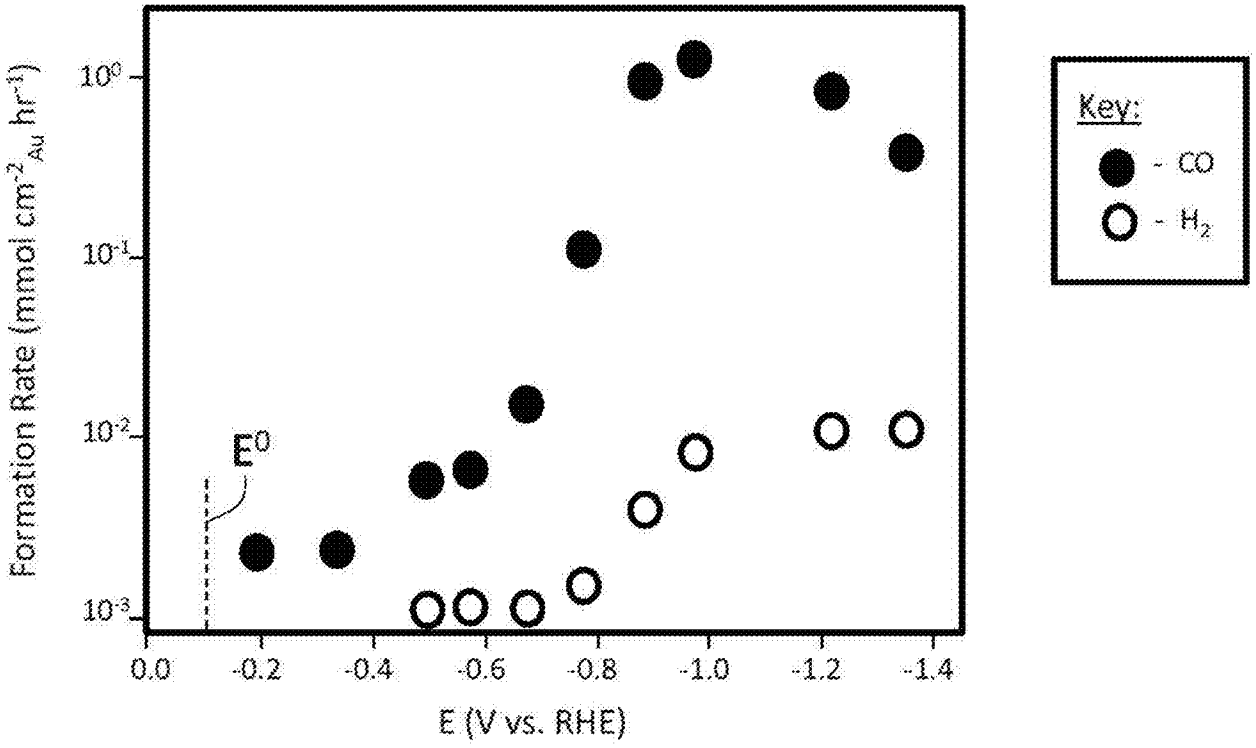
FIG. 2 illustrates the electrocatalytic activity of an $Au_{25}$ (1 nm) electrode.

FIG. 2 illustrates the electrocatalytic activity of an $Au_{25}$ electrode comprised of a plurality of nanoparticles, where individual nanoparticles in the plurality are comprised of ligand-protected $Au_{25}$ with a diameter of about 1 nm (hereafter referred to as Au25 (1 nm)), for the electrochemical reduction of $CO_2$ in an aqueous 0.1 M $KHCO_3$ electrolyte. FIG. 2 illustrates the potential-dependent product analysis and identifies significant and reproducible CO formation at an onset potential of −0.193 V vs. RHE (>95% CL, n=3). Electrolysis in $N_2$ purged $KHCO_3$ ruled out spurious CO evolution from $Au_{25}$'s organic ligands or the carbon black support. Remarkably, the onset of CO formation was within 90 mV of the $CO_2 \rightarrow CO$ formal potential (−0.103 V vs. RHE).

Figure 3:
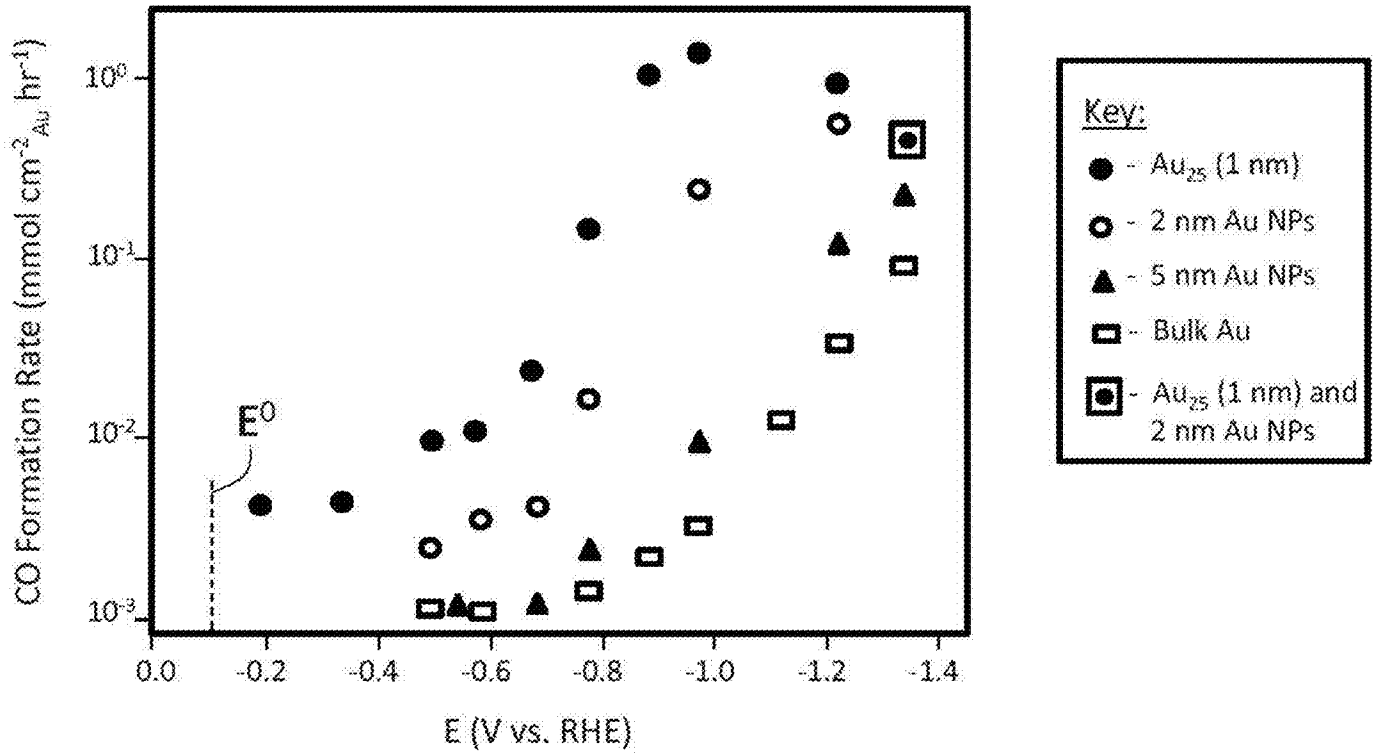
FIG. 3 illustrates the electrocatalytic activity of an $Au_{25}$ (1 nm) and 2 nm Au nanoparticles, 5 nm Au particles, and bulk Au electrodes.

FIG. 3 illustrates the Au25 (1 nm) electrocatalytic activity compared to the electrocatalytic activity observed using electrodes comprising 2 nm diameter Au nanoparticles (2 nm Au NPs), 5 nm diameter Au nanoparticles (5 nm Au NPs), and bulk Au (Bulk Au). The low overpotential of the Au25 (1 nm) constitutes an approximate 200-300 mV reduction compared to the case of the larger Au catalysts in this study, as indicated at FIG. 3.

Figure 4:
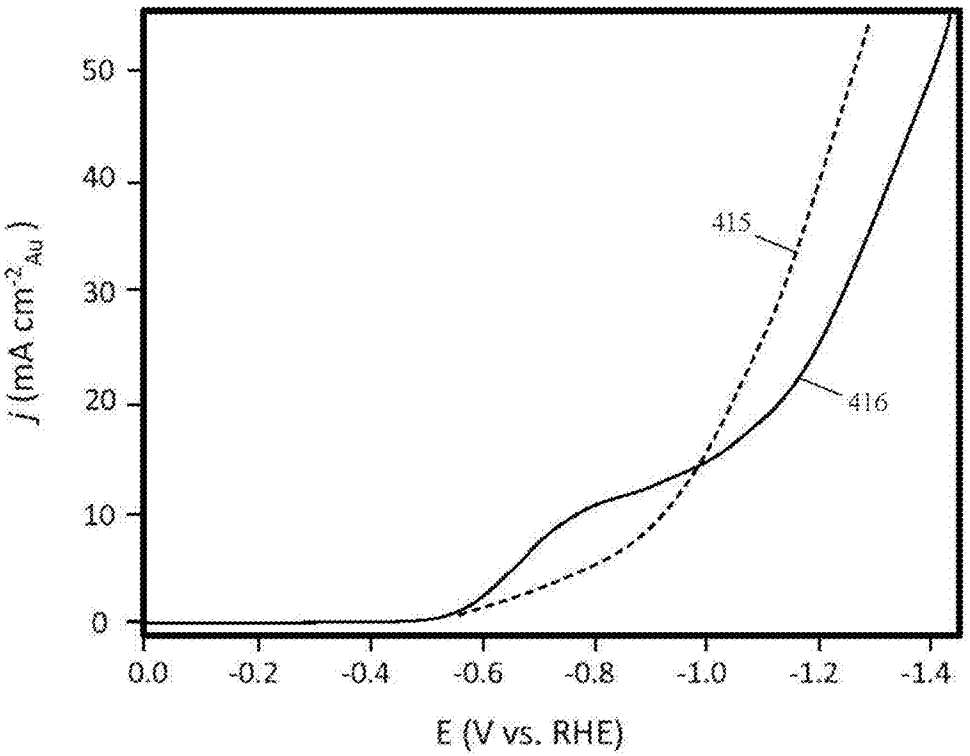
FIG. 4 illustrates linear sweep voltammograms of the $Au_{25}$ (1 nm) electrode in quiescent and $CO_2$ saturated $KHCO_3$.
Figure 5:
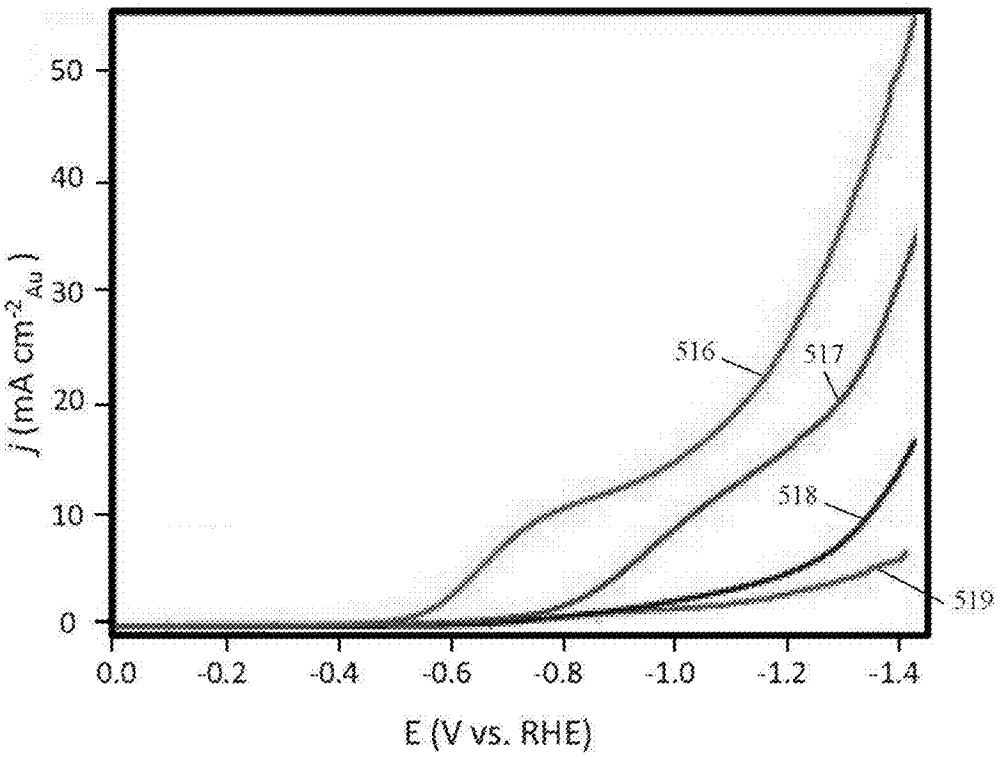
FIG. 5 illustrates linear sweep voltammograms of the $Au_{25}$ (1 nm) and 2 nm Au nanoparticles, 5 nm Au particles, and bulk Au electrodes in $CO_2$ saturated $KHCO_3$.

FIG. 4 indicates linear sweep voltammograms of the $Au_{25}$ (1 nm) electrode, illustrating the performance of the $Au_{25}$ (1 nm) electrode in quiescent (unstirred) $N_2$ purged 0.1 M $KHCO_3$ as trace 415 and the performance of the $Au_{25}$ (1 nm) electrode in $CO_2$ saturated (pH=7) 0.1 M $KHCO_3$ as trace 416. FIG. 5 illustrates the performance of the $Au_{25}$ (1 nm) electrode in $CO_2$ saturated (pH=7) 0.1 M $KHCO_3$ as trace 516, the performance of the 2 nm Au NPs electrode in $CO_2$ saturated (pH=7) 0.1 M $KHCO_3$ as trace 517, the performance of the 5 nm Au NPs electrode in $CO_2$ saturated (pH=7) 0.1 M $KHCO_3$ as trace 518, and the performance of the bulk Au electrode in $CO_2$ saturated (pH=7) 0.1 M $KHCO_3$ as trace 519.

Peak CO production from the $Au_{25}$ (1 nm) catalyst was found at −1.0 V vs. RHE with approximately 100% Faradaic efficiency (FE) and a rate 7-700 times higher than 2-5 nm Au nanoparticles and bulk Au, as indicated at FIG. 3 and further detailed at Table 1. FE relates the amount of reaction product to the total number of electrons passed through the electrode. For $Au_{25}$ (1 nm), CO formation at −1.0 V occurred with approximately 100% FE, meaning almost every electron injected into the catalyst layer was utilized for $CO_2$ reduction. Au is known to selectivity reduce $CO_2$ into CO, and CO selectivities ranged between 80.8 and 99.6% for $Au_{25}$ (1 nm), 71.0-96.9% for the larger Au nanoparticles, and 26.9-92.9% for bulk Au, depending on the applied voltage, as detailed at Table 2. However, the higher FE of the $Au_{25}$ (1 nm) cluster enhanced its CO production rate compared to the those for the other Au catalysts, as indicated at FIG. 3 and further detailed at Table 1. See also Kauffman et al., "Experimental and Computational Investigation of $Au_{25}$ Clusters and $CO_2$: A Unique Interaction and Enhanced Electrocatalytic Activity," *J. Am. Chem. Soc.* 134 (2012), and see Kauffman et al., "Supporting Information for Experimental and Computational Investigation of $Au_{25}$ Clusters and $CO_2$: A Unique Interaction and Enhanced Electrocatalytic Activity," *J. Am. Chem. Soc.* 134 (2012), which are incorporated by reference in their entirety.

The decreased $CO_2$ reduction rates beyond −1.0 V noted at FIGS. 2 and 3 may stem from gaseous products blocking the $Au_{25}$ surface. On the basis of the peak CO production rate of 1.26 mmol $cm^{-2}$ $h^{-1}$, a maximum turnover frequency (TOF)

of 87 CO molecules site$^{-1}$ s$^{-1}$ is estimated for the $Au_{25}$ (1 nm) catalyst, where sites are defined as accessible Au atoms and determined from electrochemical surface area measurements. This TOF value is approximately 10-100 times higher than those of current state-of-the-art electrochemical processes and is comparable to previous reports of CO oxidation on ligand-free $Au_n$ clusters (n=4-19).

CO and $H_2$ were the only reaction products detected, and the potential-dependent product distribution illustrated at FIG. 2 provides insight into the electrocatalytic mechanism. CO is the major CO2 reduction product for Au electrodes, and the reaction proceeds along a two-electron, two-proton pathway through an adsorbed $.CO_2^-$ intermediate, generally via the following reactions:

$$CO_2+2H^++2e^-\rightarrow CO+H_2O\ E^0=0.103\text{ V vs. RHE (pH=7)} \quad (1)$$

$$.CO_{2\,(ads)}^- \quad (2)$$

$$.CO_{2\,(ads)}^-+H^+\rightarrow .COOH_{(ads)}+e^-+H^+\rightarrow CO+H_2O \quad (3)$$

$$.CO_{2\,(ads)}^-+2H_{(ads)}\rightarrow CO+H_2O \quad (4)$$

$$H^++e^-\rightarrow H_{(ads)} \quad (5)$$

$$H_{(ads)}+H_{(ads)}\rightarrow H_2 \quad (6)$$

In the low potential regime (below −0.5 V), sequential proton capture and electron transfer converts adsorbed $.CO_2^-$ into $.COOH_{(ads)}$ before forming CO and water. A sharp increase in CO production occurred with the onset of $H_2$ evolution at approximately −0.5 V. In this potential range, the formation of $H_{(ads)}$ occurs simultaneously with $H_2$ evolution, and a $CO_2\rightarrow CO$ pathway based on the direct reduction of $.CO_2^-$ with $H_{(ads)}$ is likely. CO evolution onset potentials for the larger Au catalysts were comparable to previous results, and their equivalent values suggest the presence of similar active sites. Alternatively, the smaller CO evolution potential of $Au_{25}$ (1 nm) points to a unique catalytic site capable of promoting the $CO_2\rightarrow CO$ reaction closer to the thermodynamic limit.

$CO_2$ is not a polar molecule, but it does have a rather strong quadrupole moment and it can couple with anionic species. It is suspected that $CO_2$ adsorption was promoted, in part, by an electrostatic attraction to the negatively charged $Au_{25}$ cluster. The electrostatic potential that developed between the adsorbed $CO_2$ quadrupole and $Au_{25}$ redistributed charge within the cluster to produce reversible oxidation-like optical and electrochemical phenomena. Finally, the $Au_{25}$ electronic structure was restored by simply purging the solution with $N_2$ to desorb the weakly bound CO2.

Typical electrocatalysts require large overpotentials to convert $CO_2$ into useful products, ultimately creating a challenge for large-scale deployment. In this application, $Au_{25}$ (1 nm) catalyzed the two-electron conversion of $CO_2$ into CO within 90 mV of the formal potential (thermodynamic limit) of −0.103 V vs. the reversible hydrogen electrode (RHE). The low overpotential is significant because it represents an approximate 200-300 mV reduction in potential compared to the larger Au nanoparticles and bulk Au tested and those in previously published reports. Moreover, $Au_{25}$ (1 nm) showed peak $CO_2\rightarrow CO$ conversion at −1.0 V with approximately 100% Faradaic efficiency and a rate 7-700 times higher than those for the larger Au catalysts tested, and 10-100 times higher than those for current state-of-the-art processes. In practical terms, CO is a very useful chemical that can be converted into a variety of valuable hydrocarbon species, and a low-voltage, high-efficiency process for converting $CO_2$ into CO could be instrumental in developing new carbon management technologies.

Thus, provided here is an apparatus and method for $CO_2$ reduction using an $Au_{25}$ electrode. The $Au_{25}$ electrode is comprised of ligand-protected $Au_{25}$ having a structure comprising an icosahedral core of 13 atoms surrounded by a shell of six semi-ring structures bonded to the core of 13 atoms, where each semi-ring structure is typically —SR—Au—SR—Au—SR or —SeR—Au—SeR—Au—SeR. The 12 semi-ring gold atoms within the six semi-ring structures are stellated on 12 of the 20 faces of the icosahedron of an $Au_{13}$ core, and organic ligand SR or —SeR groups are bonded to the $Au_{13}$ core with sulfur or selenium atoms. The $Au_{25}$ electrode is typically comprised of a plurality of $Au_{25}$ nanoparticles. The $Au_{25}$ electrode and a counter-electrode are in contact with an electrolyte comprising $CO_2$ and H+, and a potential of at least −0.1 volts is applied from the $Au_{25}$ electrode to the counter-electrode. The apparatus and method produces peak $CO_2\rightarrow CO$ conversion at a potential generally around −1.0 V with approximately 100% Faradaic efficiency and a rate 7-700 times higher than those for current state-of-the-art processes.

It is to be understood that the above-described arrangements are only illustrative of the application of the principles of the present invention and it is not intended to be exhaustive or limit the invention to the precise form disclosed. Numerous modifications and alternative arrangements may be devised by those skilled in the art in light of the above teachings without departing from the spirit and scope of the present invention. It is intended that the scope of the invention be defined by the claims appended hereto.

In addition, the previously described versions of the present invention have many advantages, including but not limited to those described above. However, the invention does not require that all advantages and aspects be incorporated into every embodiment of the present invention.

All publications and patent documents cited in this application are incorporated by reference in their entirety for all purposes to the same extent as if each individual publication or patent document were so individually denoted.

TABLE 1

Potential dependent CO formulation rates and Faradaic efficiency

| E | $Au_{23}$ (1 nm) | | 2 mm Au NPs | | 5 mm Au NPs | | Bulk Au | |
|---|---|---|---|---|---|---|---|---|
| (V vs RHE) | CO (mmol cm · 2 hr · 1) | COFE (%) | CO (mmol cm · 2 hr · 1) | COFE (%) | CO (mmol cm · 2 hr · 1) | COFE (%) | CO (mmol cm · 2 hr · 1) | COFE (%) |
| 0.00 | 0 | 0 | 0 | 0 | 0 | 0 | 0 | 0 |
| −0.112 | 0 | 0 | 0 | 0 | 0 | 0 | 0 | 0 |
| −0.165 | 0 | 0 | 0 | 0 | 0 | 0 | 0 | 0 |
| −0.193 | 0.0024 ± 0.0005 | 7 ± 4 | 0 | 0 | 0 | 0 | 0 | 0 |
| −0.338 | 0.0025 | 4.2 | 0 | 0 | 0 | 0 | 0 | 0 |

TABLE 1-continued

| Potential dependent CO formulation rates and Faradaic efficiency | | | | | | | | |
|---|---|---|---|---|---|---|---|---|
| E | $Au_{23}$ (1 nm) | | 2 mm Au NPs | | 5 mm Au NPs | | Bulk Au | |
| (V vs RHE) | CO (mmol cm · 2 hr · 1) | COFE (%) | CO (mmol cm · 2 hr · 1) | COFE (%) | CO (mmol cm · 2 hr · 1) | COFE (%) | CO (mmol cm · 2 hr · 1) | COFE (%) |
| −0.499 | 0.0059 | 9.3 | 0.0013 ± 0.0003 | 8 ± 1 | 0 | 0 | 0.00057 ± 0.00007 | 13 ± 7 |
| −0.551 | — | — | — | — | 0.00057 ± 0.00003 | 11 ± 2 | — | — |
| −0.574 | 0.0066 | 9.4 | 0.0019 | 4.8 | — | — | 0.00054 | 5.0 |
| −0.675 | 0.015 | 27.2 | 0.0023 | 8.6 | 0.00063 | 4.9 | 0.00060 | 3.0 |
| −0.776 | 0.11 | 53.0 | 0.0104 | 26.6 | 0.0013 | 7.3 | 0.00071 | 4.6 |
| −0.884 | 0.94 | 104.5 | — | — | — | — | 0.0012 | 4.0 |
| −0.973 | 1.26 | 105.4 | 0.19 | 88.8 | 0.0058 | 10.6 | 0.0018 | 1.3 |
| −1.12 | — | — | — | — | — | — | 0.0077 | 5.6 |
| −1.22 | 0.84 | 97.1 | 0.48 | 91.0 | 0.091 | 75.2 | 0.023 | 2.0 |
| −1.35 | 0.39 | 96.7 | 0.37 | 97.1 | 0.18 | 98.4 | 0.066 | 46.5 |

TABLE 2

| Potential-dependent CO product selectivity | | | | |
|---|---|---|---|---|
| | CO Selectivity (%) | | | |
| E (Vvs. RHE) | $Au_{25}$ (1 nm) | 2 nm Au NPs | 5 nm Au NPs | Bulk Au |
| −0.193 | n/a | n/a | n/a | n/a |
| −0.338 | n/a | n/a | n/a | n/a |
| −0.499 | 80.8 | n/a | n/a | n/a |
| −0.551 | — | — | n/a | — |
| −0.574 | 85.7 | n/a | — | 88.7 |
| −0.675 | 94.8 | 71.0 | n/a | 73.2 |
| −0.776 | 98.7 | | n/a | 77.2 |
| −0.884 | 99.6 | — | — | 68.8 |
| −0.973 | 99.4 | 96.9 | 74.4 | 26.9 |
| −1.12 | — | — | — | 27.8 |
| −1.12 | 98.7 | 96.4 | 94.5 | 29.9 |
| −1.35 | 97.3 | 93.2 | 92.8 | 92.9 |

What is claimed is:

1. A method of reducing CO2 comprising:

establishing an $Au_{25}$ electrode in contact with an electrolyte, where the $Au_{25}$ electrode comprises ligand-protected $Au_{25}$ and where the electrolyte comprises $CO_2$ and H+;

providing a counter-electrode in contact with the electrolyte;

furnishing a voltage source comprising a negative terminal and a positive terminal where the negative terminal is in electrical communication with the $Au_{25}$ electrode and the positive terminal is in electrical communication with the counter-electrode;

generating a potential with the voltage source and generating such that a voltage difference of about −0.8 volts to about −1.2 volts from the $Au_{25}$ electrode to the counter electrode; and reducing some portion of the $CO_2$ in the electrolyte and generating CO from the some portion of the $CO_2$ in the electrolyte.

2. The method of claim 1 where the $CO_2$ comprising the electrolyte is present in an amount of at east 0.01 moles $CO_2$ per liter of electrolyte.

3. The method of claim 2 where the $Au_{25}$ electrode is comprised of a plurality of nanoparticles, there each individual nanoparticle in the plurality of nanoparticles is comprised of ligand-protected $Au_{25}$.

4. The method of claim 3 where the each individual nanoparticle comprises an $Au_{13}$ core and six semi-ring structures comprising an organic ligand, where each semi-ring structure is —SR—Au—SR—Au—SR or —SeR—Au—SeR—Au—, and where the each semi-ring structure is anchored to the $Au_{13}$ core with a sulfur or a selenium atom.

5. The method of claim 4 where the organic ligand is phenylethyl mercaptan, mercaptohexane, captopril, glutathione, mercaptobutanol, thiomalate, mercaptobenzoic acid, selenomethionine, mercaptopropionic acid, mercaptobutyric acid, mercapto-1,2-propanediol, cysteine, mercaptomethane, mercaptoethane, mercaptopropane, mercaptobutane, mercaptoethanol, mercaptomethanol, mercaptopropanol, mercaptoethylamine, mercaptoacetic acid, 1H-1,2,4-triazole-3-thiol, 5-mercapto-1-methyltetrazole, 2-mercapto-1-methylimidazole, 2-mercaptothiazoline, ethyl-2-mercaptoacetate, 2-thiouracil, 2-mercapto-5-methyl-1,3,4-thiadiazole, D-(−)-penicillamine, mercaptobenzimidazole, mercaptobenzoxazole, N-acetylL-cysteine, 2-mercapto-6-nitrobenzothiazole, 2-amino-6-mercaptopurine-9-D-riboside hydrate, diisoamylthiornalate, 3-mercaptopropanol, 4-mercaptobutanol, 2-(dimethylamino) ethanethiol, 2-mercapto-5-methyl-1,3,4-thiadiazole, and 4,5-diamino-2,6-dimercaptopyridine, and mixtures thereof.

6. The method of claim 3 further comprising:

maintaining the $Au_{25}$ electrode in contact with the electrolyte in a working electrode compartment;

maintaining the counter-electrode in contact with the electrolyte in a counter-electrode compartment;

separating the working electrode compartment and the counter-electrode compartment with a proton exchange membrane; and withdrawing a product stream comprising the CO generated from the some portion of the $CO_2$ in the electrolyte from the working electrode compartment.

7. The method of claim 1 where the electrolyte is an aqueous electrolyte comprising $H_2O$.

* * * * *